US005256993A

United States Patent [19]

Walter et al.

[11] Patent Number: 5,256,993

[45] Date of Patent: Oct. 26, 1993

[54] COIL CONTAINMENT VESSEL FOR SUPERCONDUCTING MAGNETIC ENERGY STORAGE

[75] Inventors: Robert J. Walter, Batavia; Stephen W. Meier, Bolingbrook, both of Ill.

[73] Assignee: Chicago Bridge & Iron Technical Services Company, Oak Brook, Ill.

[21] Appl. No.: 553,047

[22] Filed: Jul. 16, 1990

[51] Int. Cl.[5] ..... H01F 7/22

[52] U.S. Cl. ..... 335/216; 505/879; 62/55.5

[58] Field of Search ..... 335/216, 299, 300; 505/879, 897, 898, 899, 1; 62/55.5

[56] References Cited

U.S. PATENT DOCUMENTS 3,743,759 7/1973 Genevey ..... 335/216 X
3,980,981 9/1976 Boom et al. ..... 335/216
4,363,773 12/1982 Mine ..... 335/216
4,482,878 11/1984 Burgeson et al. ..... 335/216
4,622,531 11/1986 Eyssa et al. ..... 335/216

FOREIGN PATENT DOCUMENTS 62-279608 12/1987 Japan ..... 335/216
1-144602 6/1989 Japan ..... 335/216

*Primary Examiner*—Leo P. Picard
*Assistant Examiner*—Trinidad Korka
*Attorney, Agent, or Firm*—Marshall, O'Toole, Gerstein, Murray & Borun

[57] ABSTRACT

This invention relates to superconducting magnetic storage (SMES) apparatus made of repetitious modular units or modules which support a superconducting electrical magnet and a fluid and which are capable of efficient load transfer and are mass producible. The invention also relates to a method for making a modular SMES apparatus.

58 Claims, 4 Drawing Sheets

FIG. 5
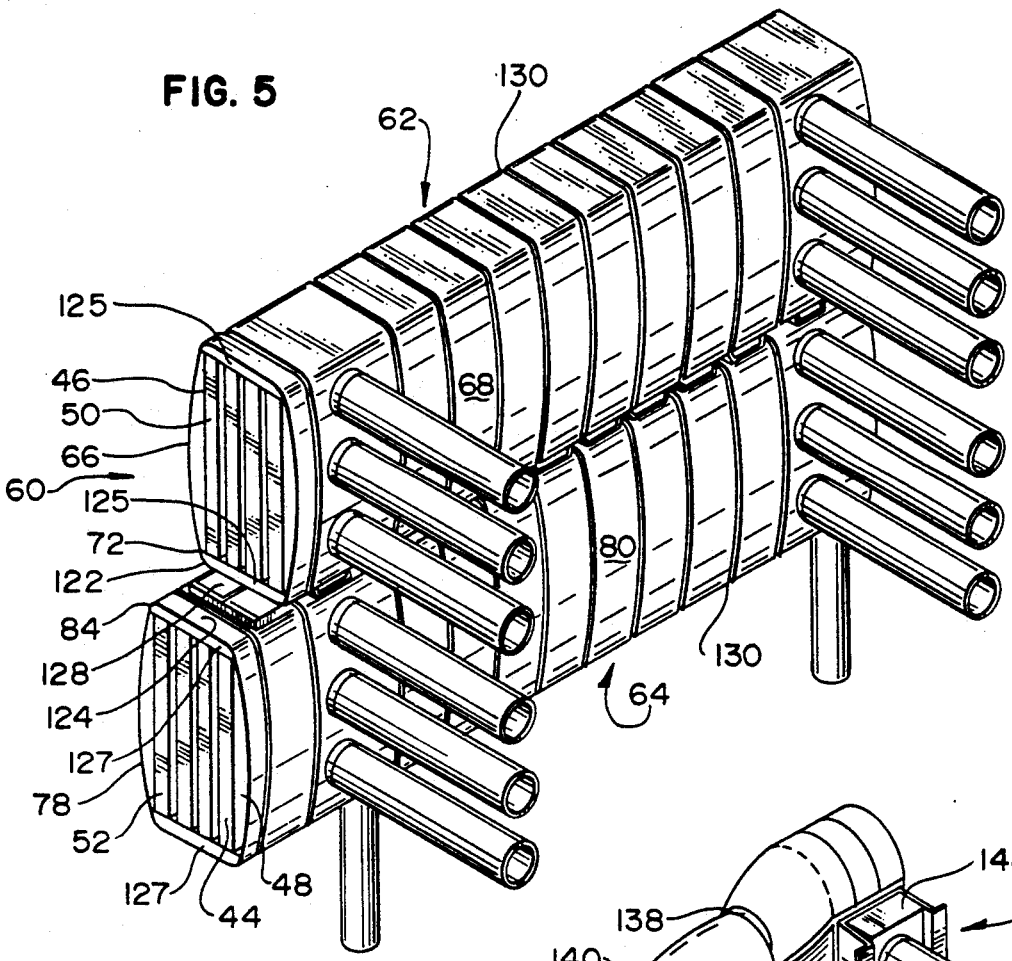
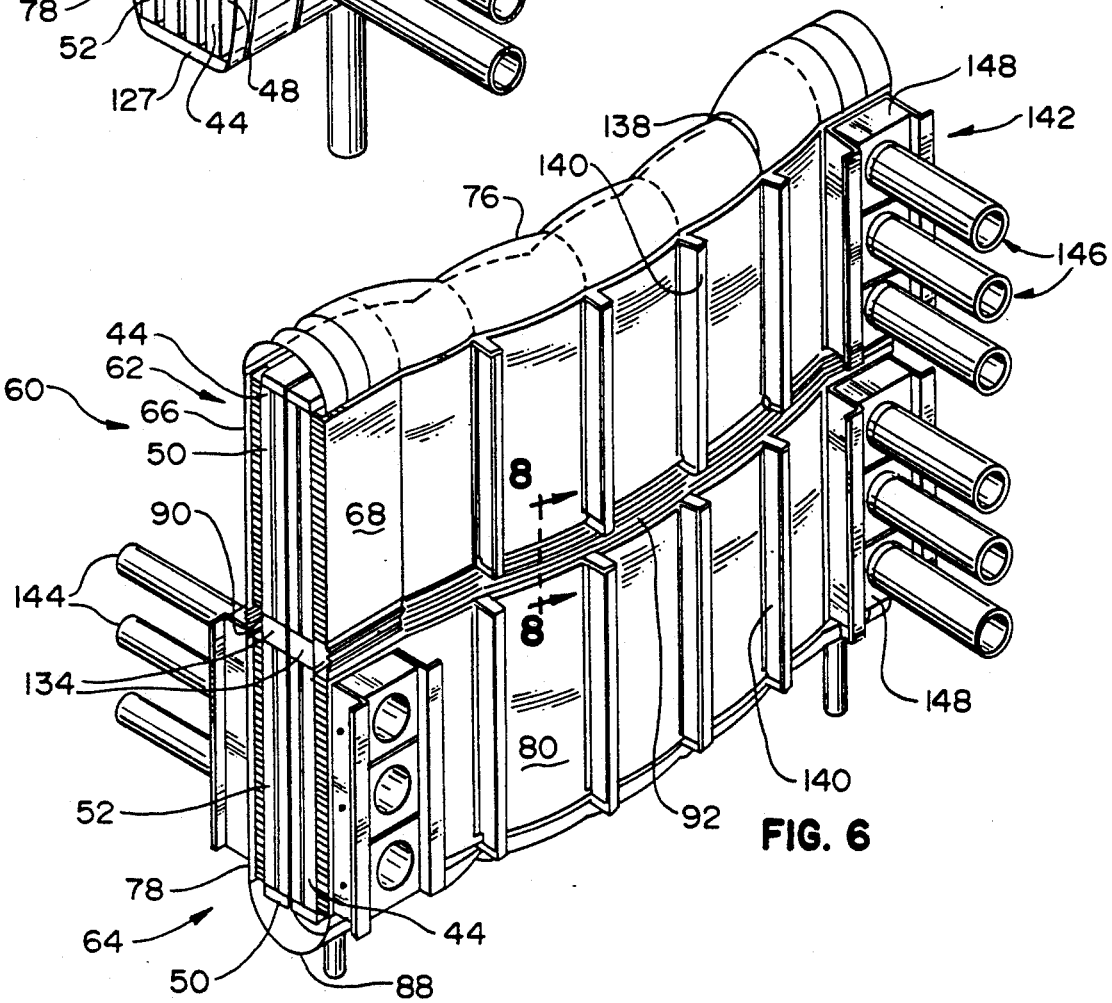
FIG. 6

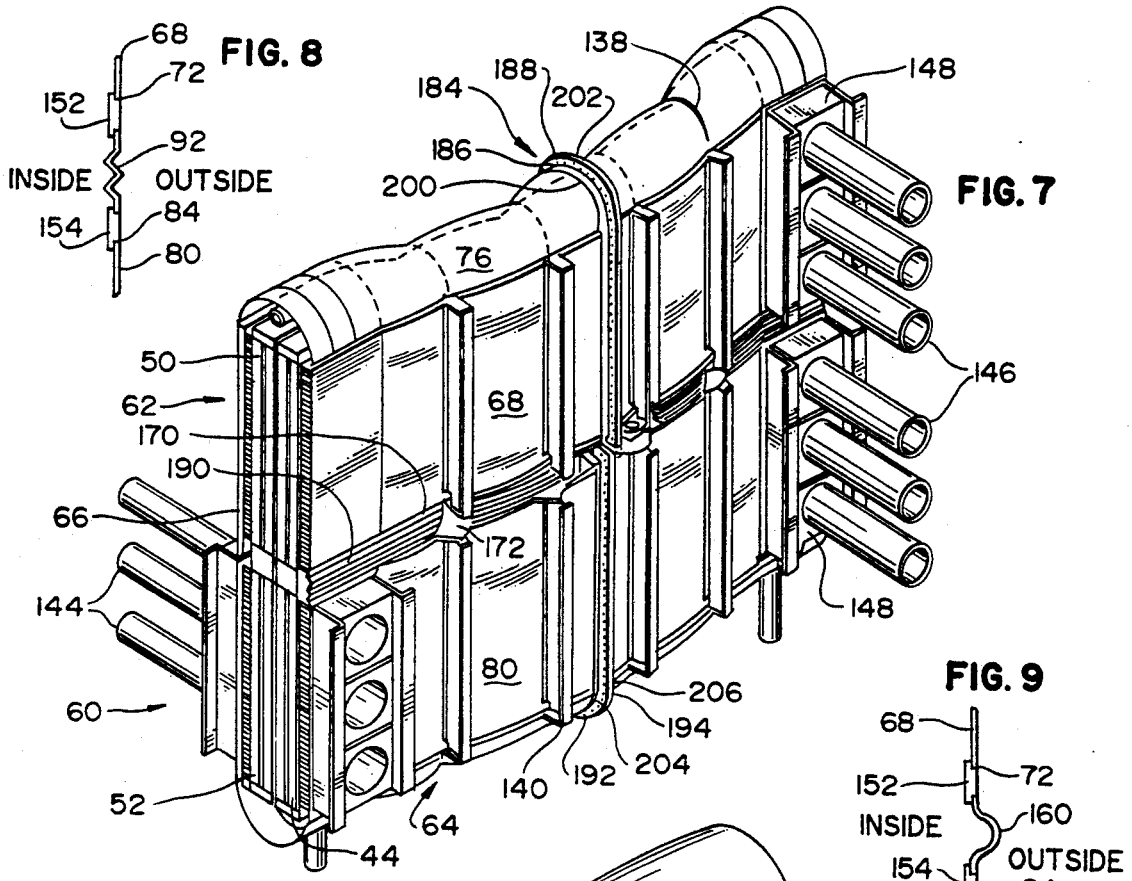
FIG. 8
68
72
152
92
INSIDE
OUTSIDE
154
84
80
FIG. 7
138
148
184
188
202
186
200
76
50
62
170
190
66
68
172
144
146
148
80
206
194
204
192
140
60
52
64
44
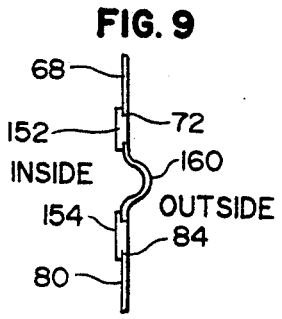
FIG. 9
68
72
152
160
INSIDE
OUTSIDE
154
84
80
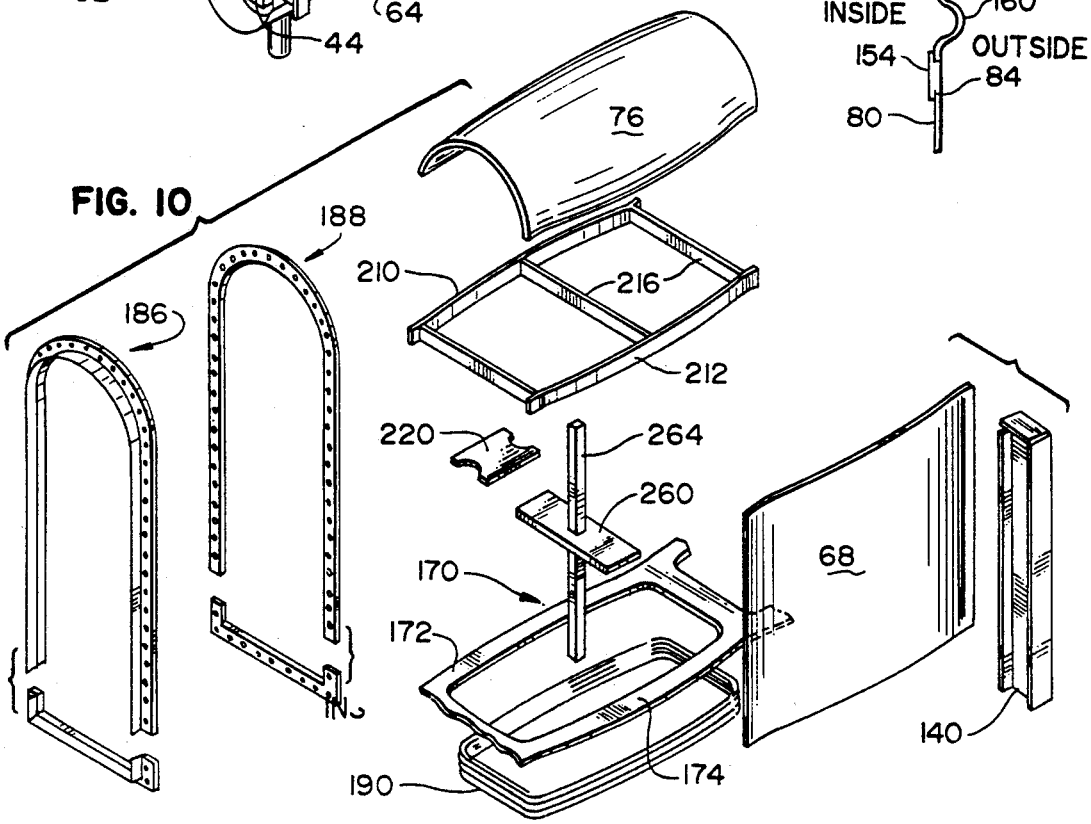
FIG. 10
76
188
210
216
186
212
220
264
260
68
170
172
140
190
174

COIL CONTAINMENT VESSEL FOR SUPERCONDUCTING MAGNETIC ENERGY STORAGE

This invention was made with Government support under Contract No. BNA-001-88-C-0027 awarded by the Defense Nuclear Agency. The Government has certain rights in this invention.

This invention relates to superconducting magnetic energy storage (SMES) apparatus. More particularly, this invention pertains to a SMES apparatus made of repetitive modular units or modules which are capable of efficient load transfer and are mass producible and also to methods for constructing a modular SMES apparatus.

BACKGROUND OF THE INVENTION

In recent years a substantial amount of research and engineering effort has been directed to the storage of electrical energy so that it would be available quickly and efficiently when needed, such as during high energy demand periods in the summer for air conditioning and in the winter for heating. It is also desirable to store electrical energy produced during the nighttime when consumption is low so that it is available for daytime use for peak shaving when demand is much greater, thereby permitting a power plant to run at a more uniform rate.

Electrical energy storage also may be used when it is desirable to generate power at a lower rate than at which it will be consumed, store the generated power in the form of electrical energy and subsequently release the stored energy to meet high rate consumption demands.

One form of electrical energy storage which has been studied extensively is the superconducting magnetic energy storage (SMES) system which is intended to operate at very low temperatures, i.e. cryogenic temperatures. One such system comprises a circular coil surrounded by a coil containment vessel containing liquefied helium at a temperature of 1.8° K. The liquefied helium cools the coil, generally aluminum and niobium-titanium, to make it superconducting by lowering electrical resistance. The coil containment vessel in turn is surrounded by a vacuum vessel, the main function of which is to minimize heat loads on the cryogenic system. A shroud between the coil containment vessel and the vacuum vessel, but surrounding the coil containment vessel, is generally also included to further prevent heat transfer. This is achieved by cooling the shroud with liquefied nitrogen. The entire apparatus as described is to be installed in a large circular trench or tunnel having inner and outer circumferential walls constructed to accept the compressive loads applied during operation of the SMES apparatus.

After a SMES apparatus is constructed and is ready to be put in use the vacuum vessel is evacuated to a suitable vacuum. This causes the vacuum vessel walls to move towards each other and also radially inwardly. The shroud is then cooled following which the coil is cooled down by filling the coil containment vessel with liquefied helium. This cooling causes the coil and coil containment vessel to contract and to move radially inwardly. After the coil is cooled to its operating temperature, the superconducting coil is charged with electricity. The charged coil produces a large radial outward magnetic load which is partially offset by the vacuum and cooldown loads. In addition to the described loads, long term creep of the surrounding foundation will occur.

The charged coil also produces a large vertical comprehensive load within the coil itself which actually reduces the height of the coil. Thus, all of these loads and movements must be accommodated while maintaining the structural and operating integrity of the SMES apparatus. This requires a coil containment vessel able to withstand a fraction of the loads and be able to transfer the remainder to an external support system. The coil containment vessel must also be able to withstand an internal pressure from the liquid helium used to cool the coil.

Coil containment vessels are generally quite large. The radius of the vessel can be one hundred to six hundred or more feet and it can be from ten to one hundred or more feet in height. As a result, construction of the vessel is difficult as the component parts are large and must be assembled below grade or in a tunnel.

From the above discussion it is believed clear that a flexible and mass-producible coil containment vessel would be useful.

SUMMARY OF THE INVENTION

According to this invention a modular coil containment vessel is provided. Generally the modular concept envisions a number of stackable rings or modules of generally similar configurations but not necessarily dimensionally identical. The height and width of the modules is preferably similar so that the module components can be mass produced and conveniently assembled on the site where the SMES unit is to be located.

In addition to being easily assembled, the modules tend to withstand the various loading conditions better than a monolithic structure because the modules can flex relative to one another as well as in unison. On the other hand, a monolithic vessel would tend to bend and twist. Thus, to avoid cracking and buckling of monolithic vessel components, heavier and more rigid materials would be required. This is costly, since even the components of a modular coil containment vessel must be sturdy and are generally made of stainless steel.

Therefore, a coil containment vessel is provided comprising a top module positioned above a bottom module; the top module comprising spaced apart inner and outer substantially endless walls defining a vessel space therebetween, the inner and outer walls having top and bottom edges, a top closure means connected to the top edges of the module walls; the bottom module comprising spaced apart inner and outer substantially endless walls defining a vessel space therebetween, the inner and outer walls having top and bottom edges, a bottom closure means connected to the bottom edges of the bottom module walls; the top module and the bottom module each being capable of holding a fluid; interfacing means extending between the top and bottom modules; a top superconducting magnetic coil positioned in the top module vessel space and supported therein; and a bottom superconducting magnetic coil positioned in the bottom module vessel space and supported therein.

Also according to the invention a modular coil containment vessel is provided comprising a top module positioned above a bottom module and at least one intermediate module positioned between the top and bottom modules: the top module comprising spaced apart inner and outer walls defining a vessel space therebetween, the inner and outer walls having top and bottom edges, a top closure means connected to the top edges of the walls; the bottom module comprising spaced apart inner and outer walls defining a vessel space therebetween, the inner and outer walls having top and bottom edges, a bottom closure means connected to the bottom edges of the bottom module walls; the intermediate module comprising radially spaced apart inner and outer walls defining a vessel space therebetween, the inner and outer walls having top and bottom edges; the top, bottom and intermediate modules each being capable of holding a fluid; interfacing means between the top of the lower module and the bottom of an intermediate module and interfacing means between the top of an intermediate module and the bottom of the top module and when more than one intermediate module is included the bottom of an upper intermediate module and the top of a lower intermediate module have between them an interfacing means; a top superconducting magnetic coil positioned in the vessel space of the top module and supported therein; a bottom superconducting magnetic coil positioned in the vessel space of the bottom module and supported there; and an intermediate superconducting magnetic coil positioned in the vessel space of the intermediate module and supported therein.

The modular coil containment vessels can have a means for making them electrically discontinuous which may include an electrical insulating material which may be positioned between opposing electrical break ends of one or more of the modules.

The coil containment vessels can include a means for providing fluid flow between the vessel spaces of the individual modules.

The interfacing means extending between the modules may include an inside fluid-tight corrugated plate means connecting the inner wall of a lower module to the inner wall of an outside fluid-tight corrugated plate means connecting the outer wall of a lower module to the outer wall of an upper module, whereby the corrugated plates deform to accommodate the relative vertical movement of the modules. In addition, there may be inner and outer ring seam plates connected to the inner and outer walls of the modules near where the walls are connected to the fluid-tight corrugated plates.

The modular coil containment vessels may also include a first horizontal substantially endless modular plate having an inner portion joined to the bottom edge of the outer wall of the top module; the first modular plate having a plurality of spaced apart apertures; a second horizontal substantially endless modular plate having an inner portion joined to the top edge of the inner wall, and an outer portion joined to the top edge of the outer wall, of an intermediate module when included; the second modular plate having a plurality of spaced apart apertures positioned below the apertures in the first modular plate; and when there is an intermediate module, a third horizontal substantially endless modular plate having an inner portion joined to the bottom edge of the inner wall, and an outer portion joined to the bottom edge of the outer wall, of an intermediate module; the third modular plate having a plurality of spaced apart apertures positioned below the apertures in the second modular plate; a fourth substantially endless modular plate having an inner portion joined to the top edge of the inner wall of the bottom module and an outer portion joined to the top edge of the outer wall of the bottom module; the fourth modular plate having a plurality of spaced apart apertures in the third modular plate; fluid-tight vertical bellows means having an upper end and a lower end, with the bellows upper end joined to the first modular plate and surrounding an aperture therein, and the bellows lower end joined to a second modular plate and surrounding an aperture therein; vertical bellows means having an upper end and a lower end, with the bellows upper end joined to a third modular plate and surrounding an aperture therein, and the bellows lower end joined to a fourth modular plate and surrounding an aperture therein; and when the vessel includes a plurality of intermediate modules, each aperture in the third modular plate is surrounded by the upper end of a separate vertical bellows means having a lower end surrounding an aperture in the second modular plate, the bellows means upper end is joined to the third modular plate and the bellows means lower end is joined to the second modular plate.

When using the modular plates, it may be desirable to add inner and outer modular seam plates joined to the inner and outer walls of the modules near where the walls are connected to the modular plates.

The modular coil containment vessel may further comprise means for transferring coil induced loads from the coil to the coil containment vessel thereby causing the two to radially expand and contract in relative substantial unison.

That means they could include one or more first horizontal guide finger plates extending radially across one or more of the apertures in the first modular plate and joined at the ends to the inner portion of the first modular plate and to the outer portion of the first modular plate; a vertical guide finger load transfer bar joined to the first guide finger and joined to the top coil thereby causing the top module to radially expand and contract with the top coil; one or more second horizontal guide finger plates extending radially across one or more of the apertures in the second modular plate and joined at the ends to the inner portion of the second modular plate and to the outer portion of the second modular plate; one or more third horizontal guide finger plates extending radially across one or more of the apertures in the third modular plate and joined at the ends to the inner portion of the third modular plate and to the outer portion of the third modular plate; a vertical intermediate guide finger load transfer bar joined at its ends to the second guide finger plate and to the third guide finger plate and joined to the intermediate coil when one is used thereby causing the intermediate module to radially expand and contract with the intermediate coil; one or more fourth horizontal guide finger plates each extending radially across one or more of the apertures in the fourth modular plate and joined at the ends to the inner portion of the fourth modular plate and to the outer portion of the fourth modular plate; and a vertical bottom guide finger load transfer bar joined to the fourth horizontal guide finger plate and joined to the bottom coil, thereby causing the bottom module to radially expand and contract with the bottom coil.

The coil containment vessel may have an interfacing means extending between the modules having inner and outer vertical substantially endless ring seam plates connected to the inner and outer walls of the modules near where the walls are connected to their respective closure means; a plurality of tie bars extending radially from the inner seam plates to the outer seam plates and connected to the seam plates; at least one horizontal coil plate connected to each tie bar; at least one top coil block connected to each top coil plate; at least one bottom coil block connected to each bottom coil plate; at least one mid-coil transition block positioned in each intermediate plate aperture and adjacent the coils in an upper and lower module; and means for restricting the maximum relative vertical displacement of the modules which could be a plurality of tie bars connected to the top and bottom coil blocks.

The coil containment vessel may also have a plurality of spaced apart interface bearing plates connected to the inner and outer walls of the modules.

The vessel may have a means for transferring loads exerted on and by the magnetic coils to structural supports located outside of the module walls.

There may be a plurality of spaced apart vertical stiffeners connected to the radial outer surface of the walls of the modules.

The modular coil containment vessel may be made of a material suitable for coil operating temperatures.

The closure means for the top and bottom modules may oppose each other and be arc-shaped in cross-section. The closure means may also be corrugated.

The modules of the containment vessel may have inner and outer walls which are substantially circular and which may be substantially vertical.

In order to withstand the radially expanding and contracting forces the inner and outer module walls may be scalloped.

In order to withstand the vertically expanding and contracting forces the inner and outer module walls may be curved.

The module walls may be canted outwardly and upwardly at the top so that the diameter of the coil is larger at the top than at the bottom and the inner and outer walls are substantially parallel.

The module walls may be canted inwardly and downwardly at the top so that the diameter of the coil is smaller at the top than at the bottom and the inner and outer walls are substantially parallel.

Also, according to this invention a method for constructing a modular coil containment vessel is provided comprising the steps of providing a bottom module capable of holding a fluid, said bottom module comprising spaced apart inner and outer substantially endless walls defining a vessel space therebetween, the inner and outer walls having top and bottom edges, a bottom closure means connected to the bottom edges of the bottom module walls; supporting a bottom superconducting magnetic coil within the vessel space of the bottom module; positioning a top module capable of holding a fluid, above said bottom module, said top module comprising spaced apart inner and outer substantially endless walls defining a vessel space therebetween, the inner and outer walls having top and bottom edges, a top closure means connected to the top edges of the module walls; supporting a top superconducting magnetic coil in the vessel space of the top module; and extending an interfacing means between the top and bottom modules.

Another method comprises the steps of providing a bottom module capable of holding a fluid, said bottom module comprising spaced apart inner and outer substantially endless walls defining a vessel space therebetween, the inner and outer walls having top and bottom edges, a bottom closure means connected to the bottom edges of the bottom module walls; supporting a bottom superconducting magnetic coil within the vessel space of the bottom module; positioning at least one intermediate module, capable of holding a fluid, above said bottom module said intermediate module comprising radially spaced apart inner and outer walls defining a vessel space therebetween, the inner and outer walls having top and bottom edges; supporting an intermediate superconducting magnetic coil within the vessel space of the intermediate module; positioning a top module, capable of holding a fluid, above said intermediate module, said top module comprising spaced apart inner and outer substantially endless walls defining a vessel space therebetween, the inner and outer walls having top and bottom edges, a top closure means connected to the top edges of the top module walls; supporting a top superconducting magnetic coil in the vessel space of the top module; and extending interfacing means between the top edges of the bottom module walls and the bottom edges of the walls of an intermediate module and between the top edges of the walls of an intermediate module and the bottom edges of the top module walls and, when more than one intermediate modules are included, between the bottom edges of the walls of an upper intermediate module and the top edges of the walls of a lower intermediate module.

These methods for constructing a modular coil containment vessel can further comprise the step of discontinuing the modules whereby they become electrically discontinuous. An electrical insulating material may then be inserted in the discontinuity of the modules.

One method of discontinuing the modules comprises the steps of providing opposing electrical break ends in the modules; and positioning a dielectric material between said opposing electrical break ends.

The methods of constructing a modular coil containment vessel may include the step of providing fluid flow between the vessel spaces of the modules.

The step of extending an interfacing means between the modules may comprise the steps of joining inside fluid-tight corrugated plate means to the inner wall of a lower module and to the inner wall of an upper module; and joining outside fluid-tight corrugated plate means to the outer wall of a lower module and to the outer wall of an upper module, whereby the corrugated plates deform to accommodate the relative vertical movement of the modules.

A method of constructing a substantially cylindrical coil containment vessel capable of holding a fluid and a superconducting magnetic coil comprising the steps of joining substantially identical arc-shaped bottom module segments end-to-end to form a substantially cylindrical bottom module; and stacking substantially identical arc-shaped top module segments end-to-end on top of the bottom module to form a substantially cylindrical top module.

This method can be expanded to include one or more layers of intermediate modules comprising the steps of joining substantially identical arc-shaped bottom module segments end-to-end to form a substantially cylindrical bottom module; stacking one or more layers of substantially identical arc-shaped intermediate vessel segments end-to-end on top of the bottom module to form one or more substantially cylindrical intermediate modules; and stacking substantially identical arc-shaped top module segments end-to-end on top of the intermediate module in the top layer to form a substantially cylindrical top module.

Also according to this invention, a method of constructing a substantially cylindrical coil containment vessel which is capable of holding a fluid and a superconducting magnetic coil is provided comprising the steps of joining substantially identical arc-shaped inner bottom module wall segments end-to-end to form an inner bottom wall; joining substantially identical arc-shaped outer bottom module wall segments end-to-end to form an outer bottom wall substantially concentric with the inner bottom wall and forming an annular bottom module space therebetween; stacking substantially identical arc-shaped inner top module wall segments end-to-end on the inner bottom wall to form an inner top module wall; stacking substantially identical arc-shaped outer top module walls segments end-to-end on the outer bottom wall to form an outer top module wall forming an annular top module space vertically aligned with the bottom module space; and joining the walls of the top module to the walls of the bottom module in a fluid-tight manner.

If an intermediate module is desired, a method is provided of constructing a substantially cylindrical coil containment vessel which is capable of holding a fluid and superconducting magnetic coil comprising the steps of joining substantially identical arc-shaped inner bottom module wall segments end-to-end to form an inner bottom module wall; joining substantially identical arc-shaped outer bottom module wall segments end-to-end to form an outer bottom module wall concentric with the inner bottom wall and forming an annular space therebetween; stacking one or more tiers of substantially identical arc-shaped inner intermediate module wall segments end-to-end on the inner bottom wall to form one or more tiers of inner intermediate module walls; stacking one or more tiers of substantially identical arc-shaped outer intermediate module wall segments end-to-end on the outer bottom module wall to form one or more tiers of outer intermediate module walls substantially concentric with the inner intermediate module walls and forming an annular space therebetween which is vertically aligned with the annular space of the bottom module; stacking substantially identical arc-shaped inner top module walls end-to-end on top of the top tier of inner intermediate module walls to form an inner top module wall; stacking substantially identical arc-shaped top module outer walls end-to-end on top of the top tier of the outer intermediate module wall to form an outer top module wall substantially concentric with the inner top module wall and forming an annular space therebetween which is vertically aligned with the annular spaces of the intermediate and bottom modules; and joining the walls of vertically adjacent modules in a fluid-tight manner.

BRIEF DESCRIPTION OF THE DRAWINGS

FIG. 5 is an isometric diagramatic view illustrating a coil containment vessel having top and bottom modules which are each self-contained.

FIG. 6 is an isometric diagramatic view illustrating a coil containment vessel having a top module which is open at the bottom and a bottom module which is open at the top.

FIG. 7 is an isometric diagramatic view illustrating a coil containment vessel having top and bottom modules which have apertures for fluid flow between the modules.

FIG. 8 is a sectional view taken along the line 8—8 of FIG. 6.

FIG. 9 is a sectional view of another embodiment of interface which can be used between adjacent module wall ends FIG. 10 is an exploded view of a top module of a coil containment vessel.

DETAILED DESCRIPTION OF THE DRAWINGS

To the extent it is reasonable and practical, the same or similar elements which appear in the various views of the drawings will be identified by the same number.

Figure 1:
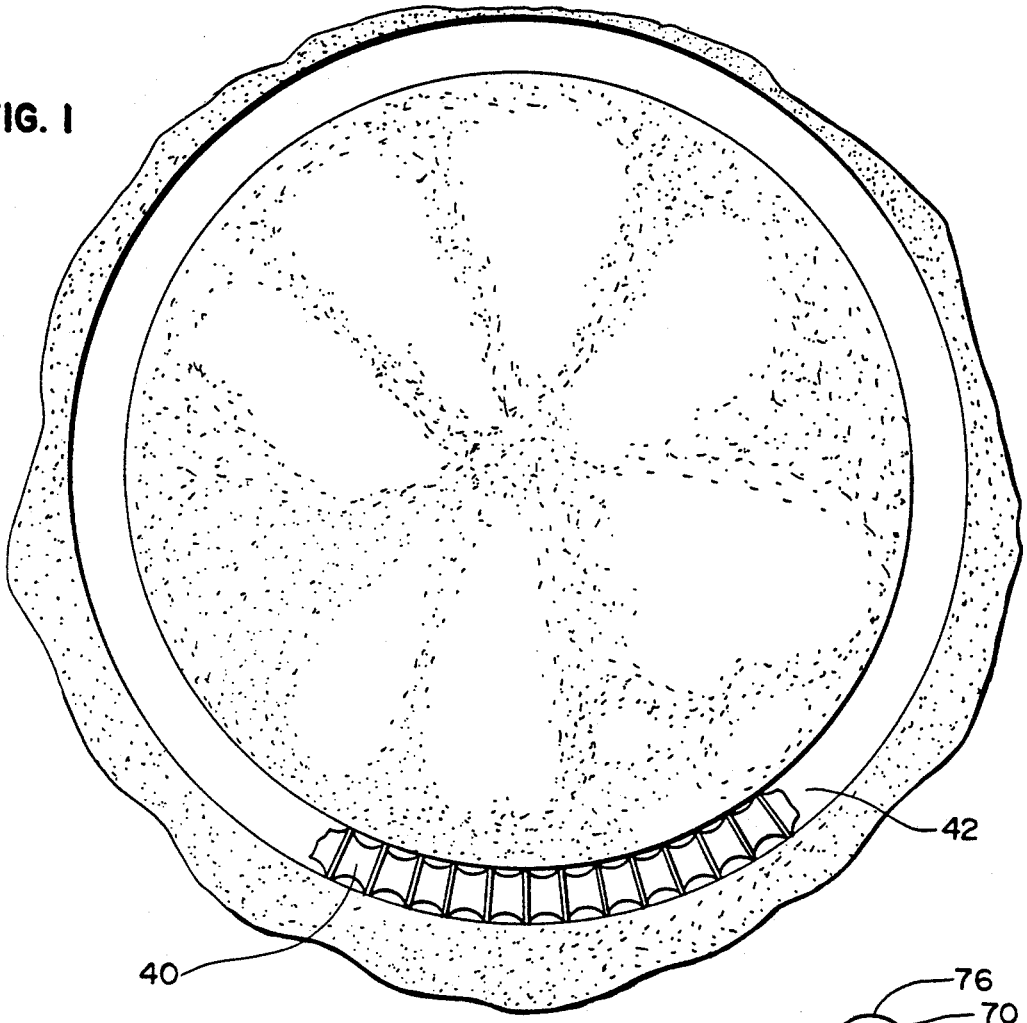
FIG. 1 is a plan view of a portion of a superconducting magnetic energy storage apparatus according to the invention.

With reference to FIG. 1 of the drawings the superconducting magnetic energy storage apparatus 40, only a portion of which is illustrated, is constructed in a circular restraining structure comprising a trench 42 excavated from solid earth or bedrock. The trench can be about fifteen to fifty feet wide, about fifty to one hundred or more feet deep and have a radius of about one hundred to six hundred or more feet, although it should be understood that the subject invention is not limited to such dimensions.

The magnetic storage apparatus includes a generally cylindrical shape coil structure 44 shown in FIGS. 5, 6, 7 and 12 with a rippled or scalloped configuration. The coil can be substantially circular or slightly elliptical when viewed in plan. The coil structure 44 has an inner circumferential face 46 and an outer circumferential face 48 (FIG. 5). The coil structure 44 is surrounded in close proximity by a generally toroidal shaped coil containment vessel 60 for liquefied helium which is to be equipped for rapid removal of the helium in case of an emergency. Such equipment is not part of this invention so it is not illustrated nor will it be described herein.

The vessel 60, which is a coil containment vessel but which in this embodiment is also a cryogenic or helium vessel since it will contain liquid helium is, according to this invention, constructed of separate modules to simplify construction and make possible the mass production of vessel components. For a cryogenic vessel it is preferable that the walls and closure plates be constructed of stainless steel.

Figure 2:
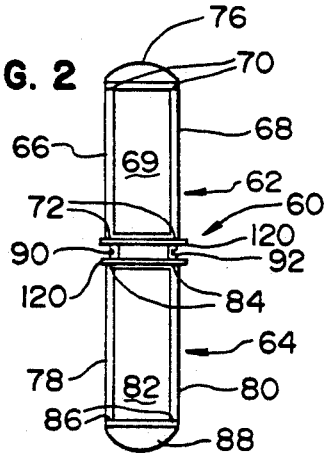
FIG. 2 is a vertical sectional view of a coil containment vessel having a top module and a bottom module.

FIG. 2 illustrates a modular coil containment vessel 60 having a top module 62 and a bottom module 64. The top module has an inner wall 66 and an outer wall 68 spaced apart to define a vessel space 69 therebetween and the walls have top edges 70 and bottom edges 72. A curved plate 76 is attached to the top edges 70 of the inner wall 66 and outer wall 68 to seal the top of the vessel space 69.

The bottom module 64 has an inner wall 78 and an outer wall 80 spaced apart to define a vessel space 82 therebetween and have top 84 and bottom 86 edges. A curved plate 88 is attached to the bottom edges 86 of the inner wall 78 and outer wall 80 to seal the bottom of the vessel space 82.

An inner bellows 90 is attached to the bottom edge 72 of the inner wall 66 of the top module 62 and to the top edge 84 of the inner wall 78 of the bottom module 64. An outer bellows 92 is attached to the bottom edge 72 of the outer wall 68 of the top module 62 and to the top edge 84 of the outer wall 80 of the bottom module 64. The inner bellows 90 and outer bellows 92 seal the vessel spaces 69 and 82 so that liquid helium can be stored in the coil containment vessel. A variety of ways are available to seal and interconnect if necessary the interface of modules and several are discussed below in greater detail.

To be accommodated by the modular vessel 60, the coil structure 44 is made of sub-units, each of which is contained in a separate module. As can be seen in FIG. 5, top coil 50 is supported in the top module and a bottom coil 52 is supported in the bottom module.

Figure 3:
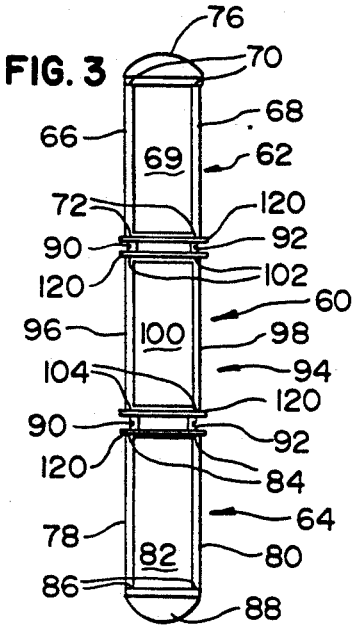
FIG. 3 is a sectional view of a coil containment vessel having a top module and a bottom module and one intermediate module.

FIG. 3 illustrates a coil containment vessel 60 having a top module 62, a bottom module 64 and an intermediate module 94. Intermediate module 94 is added to the vessel 60 to increase the overall height of the vessel without modifying the top module 62 or the bottom module 64.

Intermediate vessel 94 has an inner wall 96 and an outer wall 98 spaced apart to define a vessel space 100 therebetween and these walls have top edges 102 and bottom edges 104. Inner bellows 90 is connected to the top edge 102 of the inner wall 96 of intermediate module 94 and to the bottom edge 72 of the inner wall 66 of the top module 62. Outer bellows 92 is connected to outer wall 98 of the intermediate module 94 and the bottom edge 72 of the outer wall 68 of the top module 62.

Another inner bellows 90 is connected to the bottom edge 104 of the inner wall 96 of the intermediate module 94 and to the top edge 84 of the inner wall 78 of the bottom module 64. Another outer bellows 92 is connected to the bottom edge 104 of the outer wall 98 of the intermediate module 94 and to the top edge 84 of the outer wall 80 of the bottom module 64. Liquid helium is thereby stored in the modules and permitted to flow from module to module.

Figure 4:
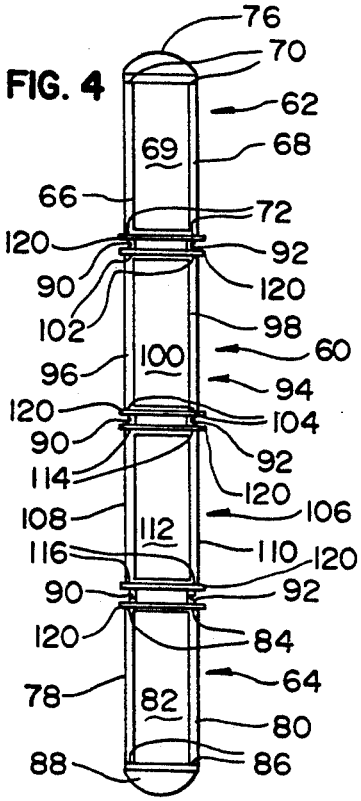
FIG. 4 is a sectional view of a coil containment vessel having a top module, a bottom module and two intermediate modules.

FIG. 4 illustrates a coil containment vessel 60 having a top module 62, a bottom module 64, a first intermediate module 94 and a second intermediate module 106. Second intermediate module 106 has an inner wall 108 and an outer wall 110 spaced apart to define a vessel space 112 therebetween having top edge 114 and bottom edge 116.

The modules are sealed by inner bellows 90 and outer bellows 92. Inner bellows 90 is connected to the bottom edge 72 of an inner wall 66 of an upper module 62 and to the top edge 102 of an inner wall 96 of a lower module 94. Outer bellows 92 is connected to the bottom edge 72 of an outer wall 68 of an upper module 62 and to the top edge 102 of an outer wall 98 of a lower module 94. Modular plates 120 are optional and can be used to improve the strength of the connection between the bellows and the module walls. Additional information of the modular plates 120 are discussed below.

It can readily be seen in FIGS. 2, 3 and 4 that any number of intermediate modules can be inserted between a top module 62 and a bottom module 64 to accommodate the required height of a magnetic coil. Therefore, it should be understood that this invention is not limited to the number of intermediate modules illustrated in the drawings.

FIG. 5 illustrates an alternative module design which is intended to isolate the top magnetic coil 50 in the top module 62 from the bottom magnetic coil 52 in the bottom module 64 by adding a bottom plate 122. One reason for isolating the coils is that under certain circumstances it may be desirable to maintain a charge in one coil and not the other. For example, if a portion of the coil in top module 62 were to go normal (lose its superconductive property), the entire module 62 should be drained of cryogenic fluid to cause the entire coil to go normal which will avoid the drastically different coil resistance that occurs between a normal coil and one that is superconducting. At the same time, the coil contained in the bottom module 64 can still be immersed in cryogenic fluid and can continue to store energy for at least partial energy storage capacity for the SMES unit.

Bottom closure plate 122 is connected to the bottom edges 72 of the inner wall 66 and outer wall 68 of the top module 62. Likewise, top closure plate 124 is connected to the top edges 84 of the inner wall 78 and outer wall 80 of the bottom module 64.

At this point it can be seen that coil 44 actually comprises a top coil 50 which is supported within the top module 62 and a bottom coil 52 which is supported within the bottom module 64. The coils are illustrated here as being arranged in four vertical layers spaced slightly apart.

Bearing plates 128 slightly separate the top module 62 from the bottom module 64 and if made of a resilient material can absorb a portion of the overall vertical compaction of the top coil 50, the bottom coil 52 and the coil containment vessel 60 which results from the tremendous electromagnetic attractive forces between the coil in the top module 62 and the coil in the bottom module 64. The coil containment vessel 60 also experiences radially expanding and contracting loads due to initial cool down of the vessel 60 and the subsequent charging of the coil 44. Corrugations 130 allow resilient deformations of the vessel 60 and bearing plates 128 allow for relative radial expansion and contraction of the top module 62 and the bottom module 64.

The top coil 50 is supported at its top and bottom in the top module 62 by top coil support blocks 125. The top coil support blocks 125 are joined to the top coil 50 and bear against both the inner wall 66 and the outer wall 68. This arrangement maintains the relative positioning of the top coil 50 and the top module 62 during radial expansion and contraction of the SMES system 40.

Likewise, the bottom coil 52 is supported at its top and bottom in the bottom module 64 by bottom coil support blocks 127. The bottom coil support blocks 127 are joined to the bottom coil 52, as illustrated, and bear against both the inner wall 78 and the outer wall 80. This arrangement maintains the relative positioning of the bottom coil 52 and the bottom module 64 during radial expansion and contraction of the SMES system 40.

The module concept illustrated in FIG. 5 permits the top coil 50 in the top module 62 to be operated independently of the bottom coil 52 in the bottom module 64 and vice versa. For example, the top coil 50 may malfunction or it simply may not be necessary to fill the top module 62 with cryogenic fluid. In such a case, it would be possible to fill the bottom module 64 with cryogenic fluid and operate the bottom coil 52 in that module. It is also possible to have any number of intermediate modules (see FIG. 4) placed between the top module 62 and bottom module 64 using this concept.

FIG. 6 illustrates a top module 62 and a bottom module 64 which are open to one another so that a cryogenic fluid may flow freely from one module to the other. The top coil 50 and the bottom coil 52 are spaced apart by interfacing blocks 134. These blocks are preferably made of a non-electricity conducting material such as a composite resin. The interfacing blocks 134 act as a spacer between the top coil 50 and the bottom coil 52 and provide a location for the interfacing between the top module 62 and the bottom bodule 64. The interfacing blocks 134 also accommodate the strong electromagnetic attractive forces between the two coils.

Because there is a slight overall contraction of the coil containment vessel 60 when the coil is charged, bellows 90 and 92 are provided for an resilient fluid-tight seal between the modules. Inside bellows 90 is attached to inner wall 66 of the top module 62 and the inside wall 78 of the bottom module 64 as described in relation to FIG. 2. Outside bellows 92 is attached to outer wall 68 of the top module 62 and to the outside wall 80 of the bottom module 64 also as described above.

FIG. 8 illustrates an embodiment of a connection detail of bellows 92 to the module walls 68 and 80. The cross-section of the bellows connection shows the outer wall 68 having a bottom edge 72. Welded to the bottom edge 72 is a top backing plate 152 which is preferably hat-shaped in cross-section. This allows the bottom edge 72 and bellows 92 to be securely welded to the top backing plate 152 from the outside of the coil containment vessel. The same is true for welding the top edge 84 of outside wall 80 to a bottom backing plate 154 and bottom backing plate 154 to outside bellows 92.

FIG. 9 illustrates a similar arrangement for the resilient connection of top module 62 to bottom module 64. Once again the edges 72 and 84 of walls 68 and 80 are welded from the outside of the coil containment vessel 60. However, in this embodiment, a single corrugated plate 160 is used instead of a bellows 92. The single corrugated plate 160 is able to provide an resilient fluid-tight seal at the junction of an upper and lower module.

To provide for resilient deformation of the curved top plate 76 one or more corrugations 138 are provided. As shown in FIG. 6, vertical stiffeners 140 are fastened to outside module walls 68 and 80 to prevent buckling. Vertical stiffeners are preferably provided for the inside walls 66 and 78, as well (see FIG. 12).

The coil containment vessel 60 is restrained from excessive radial movements by a structural support system 142 generally comprising inner restraining members 144 and outer restraining members 146. The restraining members 144 and 146 interface with the coil containment vessel 60 at the structural interface blocks 148. Preferably the structural restraining members 144 and 146 and the interface blocks 148 have a very low heat conductivity so that they transfer as little heat as possible into the coil containment vessel 60. The specific function of the exterior structural support system 142 is not part of the present invention.

FIGS. 7, 10, 11 and 12 illustrate a third embodiment of the modular coil containment vessel invention. This embodiment also permits the flow of cryogenic fluid from one module to another. The flow of fluid takes place through a series of apertures in modular plates.

A top modular plate 170 is horizontal and is continuous around the entire circumference of the coil containment vessel 60 with the possible exception of an electrical break which is explained below. The top modular plate 170 has an inner portion 172 joined to the bottom edge 72 of the inner wall 66 of the top module 62 and an outer portion 174 joined to the bottom edge 72 of the outer wall 68 of the top module 62.

Figure 12:
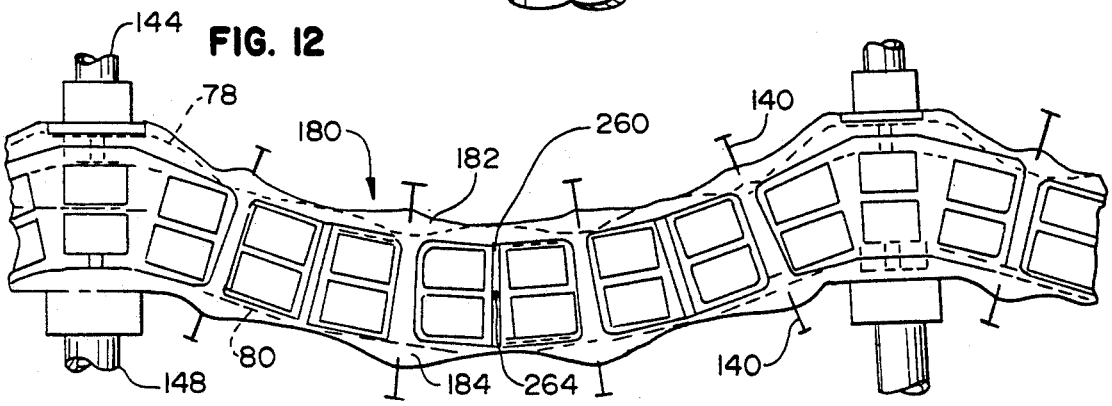
FIG. 12 is a partial plan view of a coil containment vessel made of modules having a scalloped shape.

The bottom modular plate 180 is seen in partial plan view in FIG. 12. It is also horizontal and continuous around the circumference of the coil containment vessel 60. The bottom modular plate 180 has an inner portion 182 joined to the top edge 84 of the inner wall 78 of the bottom module 64 and an outer portion 184 which is joined to the top edge 84 of the outer wall 80 of the bottom module 64. It is preferred that the apertures in the top modular plate 170 be in vertical alignment with the apertures in the bottom modular plate 180.

Having the apertures aligned permits the use of a bellows 190 which creates a fluid-tight seal around each aperture when it is connected to the top modular plate 170 and to the bottom modular plate 180 as opposed to the inner and outer continuous bellows described above. The use of the smaller bellows 190 simplifies construction of the SMES unit.

A top inside modular seam plate 192 may be used to join the inner portion 172 of the top modular plate 170 and the bottom edge 72 of the inner wall 66 of the top module 62. Likewise, a top outside modular seam plate 194 may be used to join the outer portion 174 of the top modular plate 170 to the bottom edge 72 of the outer wall 68 of the top module 62; a bottom inside modular seam plate 196 may be used to join the inner portion 182 of the bottom modular plate 180 to the top edge 84 of the inner wall 78 of the bottom module 64; and a bottom outside modular seam plate 198 may be used to join the outer portion 184 of the bottom modular plate 180 to the top edge 84 of the outer wall 80 of the bottom module 64. These modular seam plates simplify construction of the coil containment vessel 60.

Figure 13:
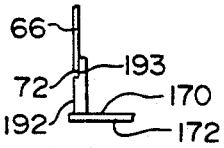
FIG. 13 is a sectional view of a modular seam plate connection.

Preferably, as illustrated in FIG. 13, the top inside modular seam plate 192 has a recess 193 which allows the inner wall 66 of the top module 62 to fit into the recess as illustrated. Therefore, if the inside modular seam plate is shop-welded to the outer edge 172 of the top modular plate 170, the inner wall 66 can be field-welded from outside the vessel 60 and a durable weld results from having the top inside modular seam plate 192 act as a backing during the welding process. Similarly, the other modular seam plates can be used to join the modular plates to the vessel walls.

Also illustrated in FIGS. 7 and 10 is an electrical break 184. Due to the high electrical charges stored in the SMES unit, it is possible that an electrical current could develop and travel around the circumference of the coil containment vessel 60. Naturally, the current would meet resistance in the stainless steel vessel walls and closure plates which in turn generates heat. It is highly undesirable to have any sort of heat load transferred to the vessel 60 since the vessel is to be maintained at low temperatures. Therefore, electrical break 184 is utilized to make the coil containment vessel 60 electrically discontinuous while maintaining the structural continuity of the vessel as a whole.

Preferably, the electrical break 184 is constructed of two opposing electrical break flanges 186 and 188 for the top module 62 and two opposing electrical break flanges 192 and 194 for the bottom module 64. The electrical break flanges 186 and 188 are connected to opposing ends 200 and 202 of the top module 62. Electrical break flange 186 is welded to the opposing end 200 at the top closure plate 76, side walls 66 and 68, and to the top modular plate 170. Electrical break flange 188 is welded to the opposing end 202.

Electrical break flange 186 is spaced apart from electrical break flange 188 by an electrical insulating material (not shown) which breaks the path of electrical current and ties the opposing ends 200 and 202 together.

Electrical break flanges 192 and 194 are connected to opposing ends 204 and 206, respectively, of the bottom modules 64 in the same fashion as described for the top module 62. Similarly, intermediate modules can be spliced with electrical break flanges and electrical insulating material. The electrical breaks for all modules should be aligned vertically because staggered electrical breaks will allow current to flow around the break in one module by being diverted from an adjacent module immediately above or below.

Figure 11:
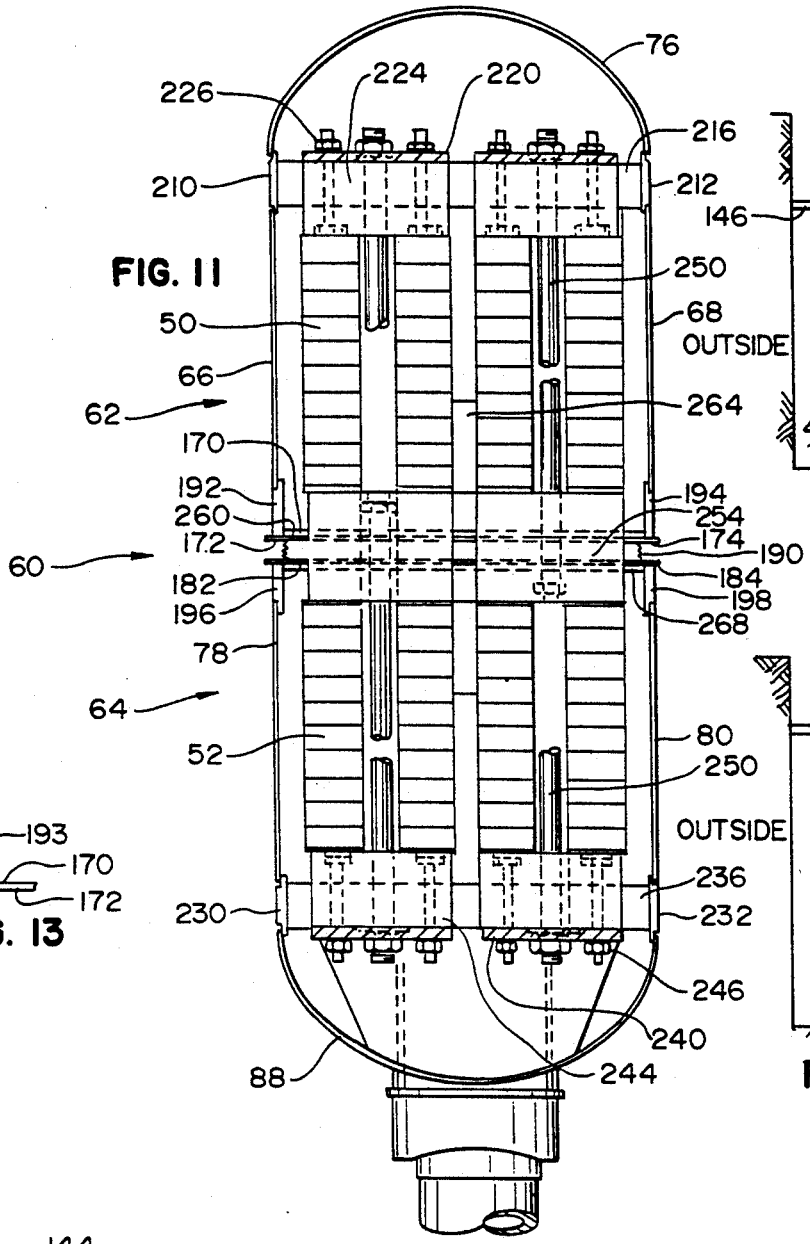
FIG. 11 is a sectional view of a coil containment vessel having a top module and a bottom module.

FIGS. 10 and 11 illustrate an embodiment for tying the top module 62 to the bottom module 64. It is generally not necessary to tie the top coil 50 to the bottom coil 52 since, when charged, the two tend to attract one another but it may be desirable for the structural continuity of the vessel 60 as a whole to be tied together vertically. Also, because the vessel 60 contains a pressurized fluid the illustrated system prevents the top closure plate 76 and bottom closure plate 88 from becoming disassociated from the vessel walls 66, 68, 78 and 80.

A top inside ring seam plate 210 is used to connect the top closure plate 76 to the inner wall 66. Preferably the inside ring seam plate 210 is hat-shaped in cross-section which allows the plates it is joining to fit into its corners as illustrated. The plates can then be welded from outside the vessel 60 and a durable weld results. Similarly, an outside ring seam plate 212 is joined to top closure plate 76 and outside wall 68.

Spanning across the vessel 60 from the inside ring seam plate 210 to the outside ring seam plate 212 are a plurality of top tie bars 216 welded at each end to the ring seam plates 210 and 212.

Top horizontal coil plates 220 are joined to the tie bars 216 which are joined to top coil blocks 224. Top coil blocks 224 bear on top of the top coil 50 and are preferably made of a electrically non-conducting material. FIG. 11 illustrates the top coil blocks 224 being bolted to the horizontal coil plates 220 with bolts 226.

A similar configuration is used in the bottom module 64. A bottom inside ring seam plate 230 joins the bottom closure plate 88 to the inside wall 78 and a bottom outside ring seam plate 232 joins the bottom closure plate 88 and the outside wall 80. A plurality of bottom tie bars 236 span across the vessel from the bottom inside ring seam plate 230 to the bottom outside ring seam plate 232 and it is welded at its ends to each bottom ring seam plate. Connected to the bottom tie bars 236 are bottom horizontal coil plates 240 which are in turn joined to bottom coil blocks 244 by bolts 246. The bottom coil 52 bears on the bottom coil blocks 244.

A plurality of tie bolts 250 may extend vertically through the entire vessel 60 and be bolted to the top horizontal coil plates 220 and to the bottom horizontal coil plates 240. Alternatively, the tie bolts 250 may only extend vertically through one module and connect to a mid-coil transition block 254. So long as the mid-coil transition block 254 is connected to both the top module 62 and the bottom module 64 by the tie bolts 250 then the desired effect of this embodiment can be realized.

It is desirable for the coil 44 and the coil containment vessel 60 to move in unison as the coil 44 radially expands and contracts due to the initial cooling down of the coil 44 and to its subsequent charging. In order to achieve the unified movement of the coil and vessel, a top guide finger bar 260 extends radially across the top module 62 and near where the modular plate 170 is attached to the walls 66 and 68 of the top module 62. The ends of the top guide finger 260 are then joined to the inner portion of the top modular plate 172 and the outer portion of the top modular plate 174 or the ends can be joined to the inner wall 66 and the outer wall 68.

A guide finger load transition bar 264 is joined to the top guide finger and extends vertically upward. The load transition bar 264 is fit between two columns of the top coil 50 and as the top coil 50 moves it exerts a force on the load transition bar 263 which in turn transfers the load to the top guide finger 260 which causes the top module 62 to move with the top coil 50.

A similar configuration is used in the bottom module 64. Bottom guide finger 268 is connected at its ends to the inner portion 182 of the bottom modular plate 180 and to the outer portion 184 of the bottom modular plate 180.

Load transfer bars 264 are provided at each vertically aligned aperture in the top modular plate 170 and the bottom modular plate 180 and are joined to the top guide finger 260 and the bottom guide finger 268. The load transfer bar 264 extends into both the top and bottom modules between vertical layers of the coil 44 so that radial movements occur in unison.

If intermediate modules are used, then an intermediate guide finger can be joined to the modular plates on the top and bottom of the intermediate module or they may be joined directly to the top and bottom of the walls of the intermediate modules. (Not illustrated.)

Despite being supported by an external structural restraining system, it is desirable to have the coil containment vessel 60 able to withstand a portion of the radially contracting and expanding strains. The embodiment illustrated in the partial plan view of FIG. 12 is a scalloped design having alternating concave and convex portions which are able to resiliently flex without compromising the structural integrity of the vessel 60 itself.

Also, by using curved or corrugated walls and closure plates those components will be able to resiliently flex under load rather than buckle inelastically. This is true where the curves and corrugations are oriented to elastically accommodate either vertical or radial movements.

Figure 14:
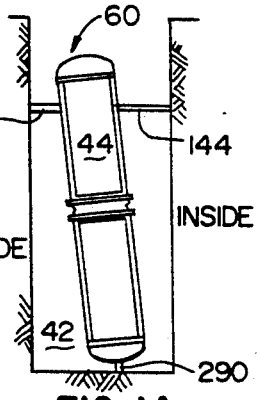
FIG. 14 is a sectional view of an outwardly canted coil containment vessel.

The walls of the coil containment vessel 60 have heretofore been described and illustrated as being vertical, however, as illustrated in FIG. 14, it may be desirable to cant the vessel 60 and the coil 44 outwardly and upwardly from the vertical at their tops so that the diameter at the top of coil 44 is larger than at the bottom. This will cause a change in the magnetic load distribution due to the tendency of a charged coil 44 to attempt to achieve a cylindrical shape. Therefore, the radially outward force at the top of the coil 44 applied to the walls of the trench 42 through the outer restraining member 146 is reduced. This is beneficial when the coil and vessel are placed in an earth trench 42 because the ability of soil to resist a lateral load increases with the depth at which the load is applied. Therefore, by reducing the radially outward load of the coil 44 near its top, the overall vertical load profile exerted by the coil begins to resemble the allowable stress profile of the soil.

Figure 15:
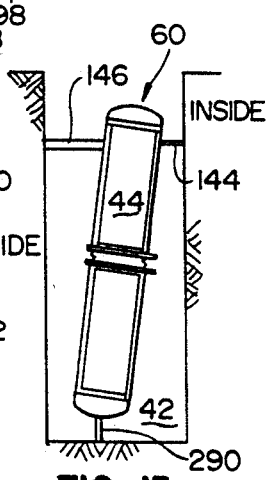
FIG. 15 is a sectional view of an inwardly canted coil containment vessel.

Inward canting can also be beneficial. Canting the vessel 60 and the coil 44, as illustrated in FIG. 15, inwardly and downwardly from the vertical at their tops so that the diameter at the top of coil 44 is smaller than at the bottom will cause a change in the magnetic load distribution so that the radially outward movement at the bottom of the vessel 60 is reduced. Reduced radial movement at the bottom of the coil 44 is beneficial because a vertical support structure 290 for the coil containment vessel 60 can be designed which need not accommodate the more extreme radial movements of a vessel of the same diameter having substantially vertical walls and coil.

The foregoing detailed description has been given for clearness of understanding only, and no unnecessary limitations should be understood therefrom, as modifications will be obvious to those skilled in the art.

What is claimed is:

1. A modular coil containment vessel comprising a top module positioned above a bottom module:

(a) the top module comprising spaced apart inner and outer substantially endless walls defining a vessel space therebetween, the inner and outer walls having top and bottom edges, a top closure means connected to the top edges of the module walls;

(b) the bottom module comprising spaced apart inner and outer substantially endless walls defining a vessel space therebetween, the inner and outer walls having top and bottom edges, a bottom closure means connected to the bottom edges of the bottom module walls;

(c) the top module and the bottom module each being capable of holding a fluid;

(d) interfacing means for transferring coil forces between the top and bottom modules;

(e) a top superconducting magnetic coil positioned in the vessel space of the top module and supported therein; and (f) a bottom superconducting magnetic coil positioned in the vessel space of the bottom module and supported therein.

2. A modular coil containment vessel according to claim 1 further comprising a means making each of the modules electrically discontinuous.

3. A modular coil containment vessel according to claim 2 in which the means making each of the modules electrically discontinuous comprises electrical insulating material.

4. A modular coil containment vessel according to claim 2 in which the means making each of the modules electrically discontinuous comprises a dielectric material positioned between opposing electrical break ends of the top and bottom modules.

5. A modular coil containment vessel according to claim 1 further comprising means providing fluid flow between the top module vessel space and the bottom module vessel space.

6. A modular coil containment vessel comprising a top module positioned above a bottom module:

(a) the top module comprising spaced apart inner and outer substantially endless walls defining a vessel space therebetween, the inner and outer walls having top and bottom edges, a top closure means connected to the top edges of the module walls;

(b) the bottom module comprising spaced apart inner and outer substantially endless walls defining a vessel space therebetween, the inner and outer walls having top and bottom edges, a bottom closure means connected to the bottom edges of the bottom module walls;

(c) the top module and the bottom module each being capable of holding a fluid;

(d) interfacing means for transferring coil forces between the top and bottom modules comprising:

(i) inside fluid-tight corrugated plate means extending between and joined to the inner wall of the top module and the inner wall of the bottom module; and (ii) outside fluid-tight corrugated plate means extending between and joined to the outer wall of the top module to the outer wall of the bottom module whereby said corrugated plates deform to accommodate the relative vertical movement of the top and bottom modules;

(e) a top superconducting magnetic coil positioned in the vessel space of the top module and supported therein; and (f) a bottom superconducting magnetic coil positioned in the vessel space of the bottom module and supported therein.

7. A modular coil containment vessel according to claim 6 further comprising inner and outer ring seam plates connected to the inner and outer walls of the top and bottom modules near where the walls are connected to the fluid-tight corrugated plates.

8. A modular coil containment vessel comprising a top module positioned above a bottom module:

(a) the top module comprising spaced apart inner and outer substantially endless walls defining a vessel space therebetween, the inner and outer walls having top and bottom edges, a top closure means connected to the top edges of the module walls;

(b) the bottom module comprising spaced apart inner and outer substantially endless walls defining a vessel space therebetween, the inner and outer walls having top and bottom edges, a bottom closure means connected to the bottom edges of the bottom module walls;

(c) the top module and the bottom module each being capable of holding a fluid;

(d) interfacing means for transferring coil forces between the top and bottom modules;

(e) a top superconducting magnetic coil positioned in the vessel space of the top module and supported therein;

(f) a bottom superconducting magnetic soil positioned in the vessel space of the bottom module and supported therein;

(g) a first horizontal substantially endless modular plate having an inner portion joined to the bottom edge of the inner wall of the top module and a radial outer portion joined to the bottom edge of the outer wall of the top module;

the first modular plate having a plurality of spaced apart apertures;

(h) a second horizontal substantially endless modular plate having an inner portion joined to the top edge of the inner wall of the bottom module and an outer portion joined to the top edge of the outer wall of the bottom module;

the second modular plate having a plurality of spaced apart apertures positioned below the apertures in the top modular plate to permit fluid flow from one module to the other; and (i) fluid-tight vertical bellows means having an upper end and a lower end, with the bellows upper end joined to the first modular plate and surrounding an aperture therein, and with the bellows lower end joined to the second modular plate and surrounding an aperture therein.

9. A modular coil containment vessel according to claim 8 further comprising:

(a) top inner and outer modular seam plates joined to the inner and outer walls of the top module, respectively, near where the walls are connected to the first horizontal modular plate; and (b) bottom inner and outer modular seam plates joined to the inner and outer walls of the bottom module, respectively, near where the walls are connected to the second horizontal modular plate.

10. A modular coil containment vessel according to claim 1 further comprising means for transferring coil induced loads from the coil to the coil containment vessel thereby causing the two to radially expand and contract in relative substantial unison.

11. A modular coil containment vessel according to claim 8, further comprising:

(a) one or more top horizontal guide finger plates extending radially across one or more of the apertures in the first modular plate and joined at the ends to the inner portion of the first modular plate and to the outer portion of the first modular plate;

(b) a vertical top guide finger load transfer bar joined to the top guide finger and joined to the top coil thereby causing the top module to radially expand and contract with the top coil;

(c) one or more bottom horizontal guide finger plates extending radially across one or more of the apertures in the second modular plate and joined at the ends to the inner portion of the bottom modular plate and to the outer portion of the bottom modular plate; and (d) a vertical bottom guide finger load transfer bar joined to the bottom guide finger and joined to the bottom boil thereby causing the bottom module to radially expand and contract with the bottom coil.

12. A modular coil containment vessel comprising a top module positioned above a bottom module:

(a) the top module comprising spaced apart inner and outer substantially endless walls defining a vessel space therebetween, the inner and outer walls having top and bottom edges, a top closure means connected to the top edges of the module walls;

(b) the bottom module comprising spaced apart inner and outer substantially endless walls defining a vessel space therebetween, the inner and outer walls having top and bottom edges, a bottom closure means connected to the bottom edges of the bottom module walls;

(c) the top module and the bottom module each being capable of holding a fluid;

(d) interfacing means for transferring coil forces between the top and bottom modules;

(e) a top superconducting magnetic coil positioned in the vessel space of the top module and supported therein;

(f) a bottom superconducting magnetic coil positioned in the vessel space of the bottom module and supported therein;

(g) inner and outer vertical cylindrical ring seam plates connected to the inner and outer walls of the top and bottom modules near where the walls are connected to their respective closure means;

(h) a plurality of tie bars extending radially from the inner seam plates to the outer seam plates and connected to the seam plates;

(i) at least one horizontal coil plate connected to each tie bar;

(j) at least one top coil block adjacent to the top coil and connected to each top coil plate;

(k) at least one bottom coil block adjacent to the bottom coil and connected to each bottom coil plate;

(l) at least one mid-coil transition block positioned (m) means for restricting the maximum relative vertical displacement of the top and bottom modules.

13. A modular coil containment vessel according to claim 12 in which the means for restricting the maximum relative vertical displacement of the top and bottom modules includes a plurality of horizontal coil plates connected to the top and bottom coil blocks.

14. A modular coil containment vessel according to claim 1 further comprising a plurality of spaced apart interface bearing blocks connected to the inner and outer walls of the modules.

15. A modular coil containment vessel according to claim 1 further comprising means for transferring loads exerted on and by the magnetic coils to structural supports located outside of the module walls.

16. A modular coil containment vessel according to claim 1 in which the vessel closure means of the coil containment modules oppose each other and are arc-shaped in radial vertical cross-section.

17. A modular coil containment vessel according to claim 1 in which the vessel closure means are at least partially corrugated.

18. A modular coil containment vessel according to claim 1 in which the inner and outer walls are scalloped to withstand radially expanding and contracting forces.

19. A modular coil containment vessel according to claim 1 in which the inner and outer walls of the top and bottom modules are curved to elastically withstand vertically expanding and contracting forces.

20. A modular coil containment vessel according to claim 1 in which the inner and outer walls are canted outwardly and upwardly at the top so that the diameter of the coil is larger at the top than at the bottom and the inner and outer walls are substantially parallel.

21. A modular coil containment vessel according to claim 1 in which the inner and outer walls are canted inwardly and downwardly at the top so that the diameter of the coil is smaller at the top than at the bottom and the inner and outer walls are substantially parallel.

22. A modular coil containment vessel comprising a top module positioned above a bottom module and at least one intermediate module positioned between the top and bottom modules:

(a) the top module comprising spaced apart inner and outer walls defining a vessel space therebetween, the inner and outer walls having top and bottom edges, a top closure means connected to the top edges of the walls;

(b) the bottom module comprising spaced apart inner and outer walls defining a vessel space therebetween, the inner and outer walls having top and bottom edges, a bottom closure means connected to the bottom edges of the bottom module walls;

(c) the intermediate module comprising radially spaced apart inner and outer walls defining a vessel space therebetween, the inner and outer walls having top and bottom edges;

(d) the top, bottom and intermediate modules each being capable of holding a fluid;

(e) interfacing means for transferring coil forces between the top of the bottom module and the bottom of an intermediate module and interfacing means for transferring coil forces between the top of an intermediate module and the bottom of the top module and when more than one intermediate module is included the bottom of an upper intermediate module and the top of a lower intermediate module have between them an interfacing means for transferring coil forces;

(f) a top superconducting magnetic coil positioned in the vessel space of the top module and supported therein;

(g) a bottom superconducting magnetic coil positioned in the vessel space of the bottom module and supported therein; and (h) an intermediate superconducting magnetic coil positioned in the vessel space of the intermediate module and supported therein.

23. A modular coil containment vessel according to claim 22 further comprising a means for making the coil containment vessel electrically discontinuous.

24. A modular coil containment vessel according to the claim 23 in which the means for making the modules electrically discontinuous comprises electrical insulating material.

25. A modular coil containment vessel according to claim 23 in which the means for making the modules electrically discontinuous comprises a dielectric material positioned between opposing electrical break ends of one or more of the modules.

26. A modular coil containment vessel according to claim 20 further comprising means providing fluid flow between the vessel spaces of the top, bottom and intermediate modules.

27. A modular coil containment vessel comprising a top module positioned above a bottom module and at least one intermediate module positioned between the top and bottom modules:

(a) the top module comprising spaced apart inner and outer walls defining a vessel space therebetween, the inner and outer walls having top and bottom edges, a top closure means connected to the top edges of the top module walls;

(b) the bottom module comprising spaced apart inner and outer walls defining a vessel space therebetween, the inner and outer walls having top and bottom edges, a bottom closure means connected to the bottom edges of the bottom module walls;

(c) each intermediate module comprising radially spaced apart inner and outer walls defining a vessel space therebetween, the inner and outer walls having top and bottom edges;

(d) the top, bottom and intermediate modules each being capable of holding a fluid;

(e) interfacing means for transferring coil forces between the top of the bottom module and the bottom of an intermediate module and interfacing means for transferring coil forces between the top of an intermediate module and the bottom of the top module and when more than one intermediate module is included the bottom of an upper intermediate module and the top of a lower intermediate module have between them an interfacing means for transferring coil forces, the interfacing means comprise:

(i) inside fluid-tight corrugated plate means connecting the inner wall of a lower module to the inner wall of an upper module; and (ii) outside fluid-tight corrugated plate means connecting the outer wall of a lower module to the outer wall of an upper module, whereby said corrugated plates deform to accommodate the relative vertical movement of the modules;

(f) a top superconducting magnetic coil positioned in the vessel space of the top module and supported therein;

(g) a bottom superconducting magnetic coil positioned in the vessel space of the bottom module and supported therein; and (h) an intermediate superconducting magnetic coil positioned in the vessel space of each intermediate module and supported therein.

28. A modular coil containment vessel according to claim 27 further comprising inner and outer ring seam plates joined to the inner and outer walls of the modules near where the walls are connected to the fluid-tight corrugated plates.

29. A modular coil containment vessel comprising a top module positioned above a bottom module and at least one intermediate module positioned between the top and bottom modules:

(a) the top module comprising spaced apart inner and outer walls defining a vessel space therebetween, the inner and outer walls having top and bottom edges, a top closure means connected to the top edges of the walls;

(b) the bottom module comprising spaced apart inner and outer walls defining a vessel space therebetween, the inner and outer walls having top and bottom edges, a bottom closure means connected to the bottom edges of the bottom module walls;

(c) each intermediate module comprising radially spaced apart inner and outer walls defining a vessel space therebetween, the inner and outer walls having top and bottom edges;

(d) the top, bottom and intermediate modules each being capable of holding a fluid;

(e) interfacing means for transferring coil forces between the top of the bottom module and the bottom of an intermediate module and interfacing means for transferring coil forces between the top of an intermediate module and the bottom of the top module and when more than one intermediate module is included the bottom of an upper intermediate module and the top of a lower intermediate module have between them an interfacing means for transferring coil forces;

(f) a top superconducting magnetic coil positioned in the vessel space of the top module and supported therein;

(g) a bottom superconducting magnetic coil positioned in the vessel space of the bottom module and supported therein;

(h) an intermediate superconducting magnetic coil positioned in the vessel space of each intermediate module and supported therein;

(i) a first horizontal substantially endless modular plate having an inner portion joined to the bottom edge of the inner wall of the top module and an outer portion joined to the bottom edge of the outer wall of the top module; the first modular plate having a plurality of spaced apart apertures;

(j) a second horizontal substantially endless modular plate having an inner portion joined to the top edge of the inner wall, and an outer portion joined to the top edge of the outer wall, of an intermediate module;

the second modular plate having a plurality of spaced apart apertures positioned below the apertures in the first modular plate;

(k) a third horizontal substantially endless modular plate having an inner portion joined to the bottom edge of the inner wall, and an outer portion joined to the bottom edge of the outer wall, of an intermediate module; the third modular plate having a plurality of spaced apart apertures positioned below the apertures in the second modular plate;

(l) a fourth horizontal substantially endless modular plate having an inner portion joined to the top edge of the inner wall of the bottom module and an outer portion joined to the top edge of the outer wall of the bottom module; the fourth modular plate having a plurality of spaced apart apertures positioned below the apertures in the third modular plate;

(m) fluid-tight vertical bellows means having an upper end and a lower end, with the bellows upper end joined to a first modular plate and surrounding an aperture therein, and the bellows lower end joined to a second modular plate and surrounding an aperture therein;

(n) vertical bellows means having an upper end and a lower end, with the bellows upper end joining to a third modular plate and surrounding an aperture therein, and the bellows lower end joined to a fourth modular plate and surrounding an aperture therein; and (o) when the vessel includes a plurality of intermediate modules, each aperture in the third modular plate is surrounded by the upper end of a separate vertical bellows means and the same vertical bellows means has a lower end surrounding an aperture in a lower modular plate, the bellows means upper end is joined to the third modular plate and the bellows means lower end is joined to the lower modular plate.

30. A modular coil containment vessel according to claim 29 further comprising inner and outer modular seam plates joined to the inner and outer walls of the modules near where the walls are connected to the modular plates.

31. A modular coil containment vessel according to claim 22 further comprising means for transferring coil induced loads from the coil to the coil containment vessel thereby causing the two to radially expand and contract in relative substantial unison.

32. A modular coil containment vessel according to claim 29 further comprising:

(a) one or more first horizontal guide finger plates extending radially across one or more of the apertures in the first modular plate and joined at the ends to the inner portion of the first modular plate and to the outer portion of the first modular plate;

(b) a vertical guide finger load transfer bar joined to the first guide finger and joined to the top coil thereby causing the top module to radially expand and contract with the top coil;

(c) one or more second horizontal guide finger plates extending radially across one or more of the apertures in the second modular plate and joined at the ends to the inner portion of the second modular plate and to the outer portion of the second modular plate;

(d) one or more third horizontal guide finger plates extending radially across one or more of the apertures in the third modular plate and joined at the ends to the inner portion of the third modular plate and to the outer portion of the third modular plate;

(e) a vertical intermediate guide finger load transfer bar joined at its ends to the second guide finger plate and to the third guide finger plate and joined to the intermediate coil thereby causing the intermediate module to radially expand and contract with the intermediate coil;

(f) one or more fourth horizontal guide finger plates each extending radially across one or more of the apertures in the fourth modular plate and joined at the ends to the inner portion of the fourth modular plate and to the outer portion of the fourth modular plate; and (g) a vertical bottom guide finger load transfer bar joined to the fourth horizontal guide finger plate and joined to the bottom coil, thereby causing the bottom module to radially expand and contract with the bottom coil.

33. A modular coil containment vessel comprising a top module positioned above a bottom module and at least one intermediate module positioned between the top and bottom modules:

(a) the top module comprising spaced apart inner and outer walls defining a vessel space therebetween, the inner and outer walls having top and bottom edges, a top closure means connected to the top edges of the walls;

(b) the bottom module comprising spaced apart inner and outer walls defining a vessel space therebetween, the inner and outer walls having top and bottom edges, a bottom closure means connected to the bottom edges of the bottom module walls;

(c) each intermediate module comprising radially spaced apart inner and outer walls defining a vessel space therebetween, the inner and outer walls having top and bottom edges;

(d) the top, bottom and intermediate modules each being capable of holding a fluid;

(e) interfacing means for transferring coil forces between the top of the bottom module and the bottom of an intermediate module and interfacing means for transferring coil forces between the top of an intermediate module and the bottom of the top module and when more than one intermediate module is included the bottom of an upper intermediate module and the top of a lower intermediate module have between them an interfacing means for transferring coil forces;

(f) a top superconducting magnetic coil positioned in the vessel space of the top module and supported therein;

(g) a bottom superconducting magnetic coil positioned in the vessel space of the bottom module and supported therein;

(h) an intermediate superconducting magnetic coil positioned in the vessel space of each intermediate module and supported therein;

the interfacing means for transferring coil forces between modules comprises:

(i) inner and outer vertical substantially endless ring seam plates connected to the inner and outer walls of the modules near where the walls are connected to their respective closure means;

(ii) a plurality of tie bars extending radially from the inner seam plates to the outer seam plates and connected to the seam plates;

(iii) at least one horizontal coil plate connected to each tie bar;

(iv) at least one top coil block connected to each top coil plate;

(v) at least one bottom coil block connected to each bottom coil plate;

(vi) at least one mid-coil transition block positioned adjacent the coils in an upper and lower module; and (vii) means for restricting the maximum relative vertical displacement of the modules.

34. A modular coil containment vessel according to claim 33 in which the means for restricting the maximum relative vertical displacement of the modules includes a plurality of horizontal coil plates connected to the top and bottom coil blocks.

35. A modular coil containment vessel according to claim 22 further comprising plurality of spaced apart interface bearing blocks connected to the inner and outer walls of the modules.

36. A modular coil containment vessel according to claim 22 further comprising means for transferring loads exerted on and by the magnetic coils to structural supports located outside of the module walls.

37. A modular coil containment vessel according to claim 22 in which the closure means of the coil containment modules oppose each other and are arc-shaped in cross-section.

38. A modular coil containment vessel according to claim 20 in which the closure means are corrugated.

39. A modular coil containment vessel according to claim 20 in which the inner and outer walls are scalloped to withstand radially expanding and contracting forces.

40. A modular coil containment vessel according to claim 20 in which the inner and outer walls of the modules are curved to elastically withstand vertically expanding and contracting forces.

41. A modular coil containment vessel according to claim 22 in which the inner and outer walls are canted outwardly and upwardly at the top so that the diameter of the coil is larger at the top than at the bottom and the inner and outer walls are substantially parallel.

42. A modular coil containment vessel according to claim 22 in which the inner and outer walls are canted inwardly and downwardly at the top so that the diameter of the coil is smaller at the top than at the bottom and the inner and outer walls are substantially parallel.

43. A method for constructing a modular coil containment vessel comprising the steps of:

(a) providing a bottom module, capable of holding a fluid, said bottom module comprising spaced apart inner and outer substantially endless walls defining a vessel space therebetween, the inner and outer walls having top and bottom edges, a bottom closure means connected to the bottom edges of the bottom module walls;

(b) supporting a bottom superconducting magnetic coil within the vessel space of the bottom module;

(c) positioning a top module, capable of holding a fluid, above said bottom module, said top module comprising spaced apart inner and outer substantially endless walls defining a vessel space therebetween, the inner and outer walls having top and bottom edges, a top closure means connected to the top edges of the module walls;

(d) supporting a top superconducting magnetic coil in the vessel space of the top module; and (e) extending an interfacing means for transferring coil forces between the top and bottom modules.

44. A method according to claim 43 further comprising the step of discontinuing the top module and bottom module whereby they become electrically discontinuous.

45. A method according to claim 44 further comprising the step of inserting an electrical insulating material in the discontinuities of the top and bottom modules.

46. A method according to claim 44 in which the step of discontinuing the modules comprises the steps of:

(a) providing opposing electrical break ends in the top and bottom modules; and (b) positioning a dielectric material between said opposing electrical break ends.

47. A method according to claim 43 further comprising the step of providing fluid flow between the top module vessel space and the bottom module vessel space.

48. The method according to claim 43 in which the step of extending an interfacing means between the top and bottom modules comprises the steps of:

(a) joining an inside fluid-tight corrugated plate to the inner wall of the top module and the inner wall of the bottom module; and (b) joining an outside fluid-tight corrugated plate to the outer wall of the top module and the outer wall of the bottom module whereby said corrugated plates deform to accommodate the relative vertical movement of the top and bottom modules.

49. A method for constructing a modular coil containment vessel comprising the steps of:

(a) providing a bottom module capable of holding a fluid, said bottom module comprising spaced apart inner and outer substantially endless walls defining a vessel space therebetween, the inner and outer walls having top and bottom edges, a bottom closure means connected to the bottom edges of the bottom module walls;

(b) supporting a bottom superconducting magnetic coil within the vessel space of the bottom module;

(c) positioning at least one intermediate module, capable of holding a fluid, above said bottom module, said intermediate module comprising radially spaced apart inner and outer walls defining a vessel space therebetween, the inner and outer walls having top and bottom edges;

(d) supporting an intermediate superconducting magnetic coil within the vessel space of the intermediate module;

(e) positioning a top module capable of holding a fluid above said intermediate module, said top module comprising spaced apart inner and outer substantially endless walls defining a vessel space therebetween, the inner and outer walls having top and bottom edges, a top closure means connected to the top edges of the module walls;

(f) supporting a top superconducting magnetic coil in the vessel space of the top module; and (g) extending interfacing means for transferring coil forces between the top edges of the bottom module walls and the bottom edges of the walls of an intermediate module and between the top edges of the walls of an intermediate module and the bottom edges of the top module walls and, when more than one intermediate modules are included, between the bottom edges of the walls of an upper intermediate module and the top edges of the walls of a lower intermediate module.

50. A method according to claim 49 further comprising the step of discontinuing the top module, intermediate module and the bottom module whereby they become electrically discontinuous.

51. A method according to claim 50 further comprising the step of inserting an electrical insulating material in the discontinuities of the top, intermediate and bottom modules.

52. A method according to claim 50 in which the step of discontinuing the modules comprising the steps of:

(a) providing opposing electrical break ends in the top, intermediate and bottom modules; and (b) positioning a dielectric material between said opposing electrical break ends.

53. A method according to claim 49 further comprising the step of providing a fluid flow between the vessel spaces of the top, bottom and intermediate modules.

54. A method according to claim 49, in which the step of extending an interfacing means between the modules comprises the steps of:

(a) joining inside fluid-tight corrugated plate means to the inner wall of a lower module to the inner wall of an upper module; and (b) joining outside fluid-tight corrugated plate means to the outer wall of a lower module to the outer wall of an upper module, whereby the corrugated plates deform to accommodate the relative vertical movement of the modules.

55. A method of constructing a substantially cylindrical coil containment vessel capable of holding a fluid and a superconducting magnetic coil comprising the steps of:

(a) joining substantially identical arc-shaped bottom module segments end-to-end to form a substantially cylindrical bottom module; and (b) stacking substantially identical arc-shaped top module segments end-to-end on top of the bottom module to form a substantially cylindrical top module.

56. A method of constructing a substantially cylindrical coil containment vessel capable of holding a fluid and a superconducting magnetic coil, comprising the steps of:

(a) joining substantially identical arc-shaped bottom module segments end-to-end to form a substantially cylindrical bottom module;

(b) stacking one or more layers of substantially identical arc-shaped intermediate vessel segments end-to-end on top of the bottom module to form one or more substantially cylindrical intermediate modules; and (c) stacking substantially identical arc-shaped top module segments end-to-end on top of the intermediate module in the top layer to form a substantially cylindrical top module.

57. A method of constructing a substantially cylindrical coil containment vessel which is capable of holding a fluid and a superconducting magnetic coil comprising the steps of:

(a) joining substantially identical arc-shaped inner bottom module wall segments end-to-end to form an inner bottom wall;

(b) joining substantially identical arc-shaped outer bottom module wall segments end-to-end to form an outer bottom wall substantially concentric with the inner bottom wall and forming an annular bottom module space therebetween;

(c) stacking substantially identical arc-shaped inner top module wall segments end-to-end on the inner bottom wall to form an inner top module wall; and (d) stacking substantially identical arc-shaped outer top module wall segments end-to-end on the outer bottom wall to form an outer top module wall forming an annular top module space vertically aligned with the bottom module space; and (e) joining the walls of the top module to the walls of the bottom module in a fluid-tight manner.

58. A method of constructing a substantially cylindrical coil containment vessel which is capable of holding a fluid and a superconducting magnetic coil comprising the steps of:

(a) joining substantially identical arc-shaped inner bottom module wall segments end-to-end to form an inner bottom module wall;

(b) joining substantially identical arc-shaped outer bottom module wall segments end-to-end to form an outer bottom module wall concentric with the inner bottom wall and forming an annular space therebetween;

(c) stacking one or more tiers of substantially identical arc-shaped inner intermediate module wall segments end-to-end on the inner bottom wall to form one or more tiers of inner intermediate module walls;

(d) stacking one or more tiers of substantially identical arc-shaped outer intermediate module wall segments end-to-end on the outer bottom module wall to form one or more tiers of outer intermediate module walls substantially concentric with the inner intermediate module walls and forming an annular space therebetween which is vertically aligned with the annular space of the bottom module;

(e) stacking substantially identical arc-shaped inner top module walls end-to-end on top of the top tier of inner intermediate module walls to form an inner top module wall;

(f) stacking substantially identical arc-shaped top module outer walls end-to-end on top of the top tier of the outer intermediate module wall to form an outer top module wall substantially concentric with the inner top module wall and forming an annular space therebetween which is vertically aligned with the annular spaces of the intermediate and bottom modules; and (g) joining the walls of vertically adjacent modules in a fluid-tight manner.

* * * * *